US006913212B2

(12) United States Patent
Augustin

(10) Patent No.: US 6,913,212 B2
(45) Date of Patent: Jul. 5, 2005

(54) OIL ACTIVATED FUEL INJECTOR CONTROL WITH DELAY PLUNGER

(75) Inventor: Ulrich Augustin, Blythewood, SC (US)

(73) Assignee: Siemens Diesel Systems Technology, LLC, Blythewood, SC (US)

( * ) Notice: Subject to any disclaimer, the term of this patent is extended or adjusted under 35 U.S.C. 154(b) by 301 days.

(21) Appl. No.: 09/983,040

(22) Filed: Oct. 22, 2001

(65) Prior Publication Data

US 2002/0092920 A1 Jul. 18, 2002

Related U.S. Application Data

(60) Provisional application No. 60/261,811, filed on Jan. 17, 2001.

(51) Int. Cl.[7] ..... F02M 51/00
(52) U.S. Cl. ..... 239/585.1; 239/585.5
(58) Field of Search ..... 239/88–97, 124, 239/125, 585.1–585.5

(56) References Cited

U.S. PATENT DOCUMENTS 3,796,206 A * 3/1974 Links ..... 123/457
4,219,154 A * 8/1980 Luscomb ..... 239/91
4,527,737 A * 7/1985 Deckard ..... 239/89
4,658,791 A 4/1987 Absenger et al.
RE33,270 E * 7/1990 Beck et al. ..... 123/447
5,280,773 A 1/1994 Henkel
5,320,278 A 6/1994 Kolarik et al.
5,535,723 A 7/1996 Gibson et al.
5,551,398 A 9/1996 Gibson et al.
5,655,501 A 8/1997 Hafner
5,785,021 A 7/1998 Yudanov et al.
5,852,997 A 12/1998 Vanderpoel
5,865,156 A 2/1999 Feucht et al.
6,012,429 A 1/2000 Beatty et al.
6,116,273 A 9/2000 Tarr et al.

* cited by examiner

*Primary Examiner*—David A. Scherbel
*Assistant Examiner*—Thach H Bui
(74) *Attorney, Agent, or Firm*—McGuireWoods LLP

(57) ABSTRACT

An oil activated fuel injector which provides a pilot quantity of fuel prior to the main fuel injection event. The oil activated fuel injector includes a throttle which provides fluid communication between the high pressure chamber and a fuel bore which leads to the nozzle of the oil activated fuel injector. The pilot quantity of fuel flows through the throttle and into the fuel bore during a pre stroke of the plunger. The oil activated fuel injector reduces engine emissions and noise, and eliminates the need for additional working fluid to be provided therein in order to provide a pilot quantity of fuel.

3 Claims, 5 Drawing Sheets

OIL ACTIVATED FUEL INJECTOR CONTROL WITH DELAY PLUNGER

CROSS REFERENCE TO RELATED APPLICATION

This application claims priority to U.S. provisional application Ser. No. 60/261,811, filed on Jan. 17, 2001.

BACKGROUND OF THE INVENTION

1. Field of the Invention

The present invention generally relates to an oil activated fuel injector and, more particularly, to an oil activated electronically or mechanically controlled fuel injector control with a delay plunger.

2. Background Description

There are many types of fuel injectors designed to inject fuel into a combustion chamber of an engine. For example, fuel injectors may be mechanically, electrically or hydraulically controlled in order to inject fuel into the combustion chamber of the engine. In the hydraulically actuated systems, a control valve body may be provided with two, three or four way valve systems, each having grooves or orifices which allow fluid communication between working ports, high pressure ports and venting ports of the control valve body of the fuel injector and the inlet area. The working fluid is typically engine oil or other types of suitable hydraulic fluid which is capable of providing a pressure within the fuel injector in order to begin the process of injecting fuel into the combustion chamber.

In current designs, a driver will deliver a current or voltage to an open side of an open coil solenoid. The magnetic force generated in the open coil solenoid will shift a spool into the open position so as to align grooves or orifices (hereinafter referred to as "grooves") of the control valve body and the spool. The alignment of the grooves permits the working fluid to flow into an intensifier chamber from an inlet portion of the control valve body (via working ports). The high pressure working fluid then acts on an intensifier piston to compress an intensifier spring and hence compress fuel located within a high pressure plunger chamber. As the pressure in the high pressure plunger chamber increases, the fuel pressure will begin to rise above a needle check valve opening pressure. At the prescribed fuel pressure level, the needle check valve will shift against the needle spring and open the injection holes in a nozzle tip. The fuel will then be injected into the combustion chamber of the engine.

However, in such a conventional system, a small quantity (pilot injection) of fuel cannot be efficiently injected into the engine during a pre-stroke phase of the plunger. This leads to higher emissions and engine noise. The smaller quantities of fuel cannot be efficiently injected into the engine because once the solenoid valve of the injector is opened a larger quantity of fuel is injected into the engine. To provide a smaller quantity of fuel, a delay of the pre-stroke of the plunger must be provided. But, this can only be provided in the conventional system by adding more working fluid, under high pressure, into the injector. The additional pressurized working fluid may cause a delay; however, additional energy from the high pressure oil pump must be expanded in order to provide this additional working fluid. This leads to an inefficiency in the operations of the fuel injector, itself, and also does not provide a consistent supply of fuel into the engine.

The present invention is directed to overcoming one or more of the problems as set forth above.

SUMMARY OF THE INVENTION

In a first aspect of the present invention, a fuel injector with a throttle for providing a pilot quantity of fuel is provided. The fuel injector includes a spool slidable between a first position and a second position and an open and closed solenoid positioned on respective sides of the spool. An intensifier body is positioned proximate to the spool and a piston is slidably positioned within the intensifier body. A plunger is in contact with the piston which has a cross bore and a longitudinal bore in fluid communication with the cross bore. A high pressure chamber is formed below the plunger. A fuel bore is positioned within the intensifier body as well as a check disk, in embodiments. The throttle is in fluid communication with the fuel bore and may be located within the plunger, the intensifier body or the check disk.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

The present invention is directed to an oil activated electronically, mechanically or hydraulically controlled fuel injector which is capable of delaying the first plunger motion without the need for additional oil or hydraulic fluid. This delay allows a small quantity of fuel (pilot injection) to be injected into the engine prior to the main injection event. The oil activated fuel injector of the present invention will thus increase efficiency of the injection cycle and decrease engine noise and engine emissions.

Embodiments of the Oil Activated Fuel Injector of the Present Invention

Figure 1:
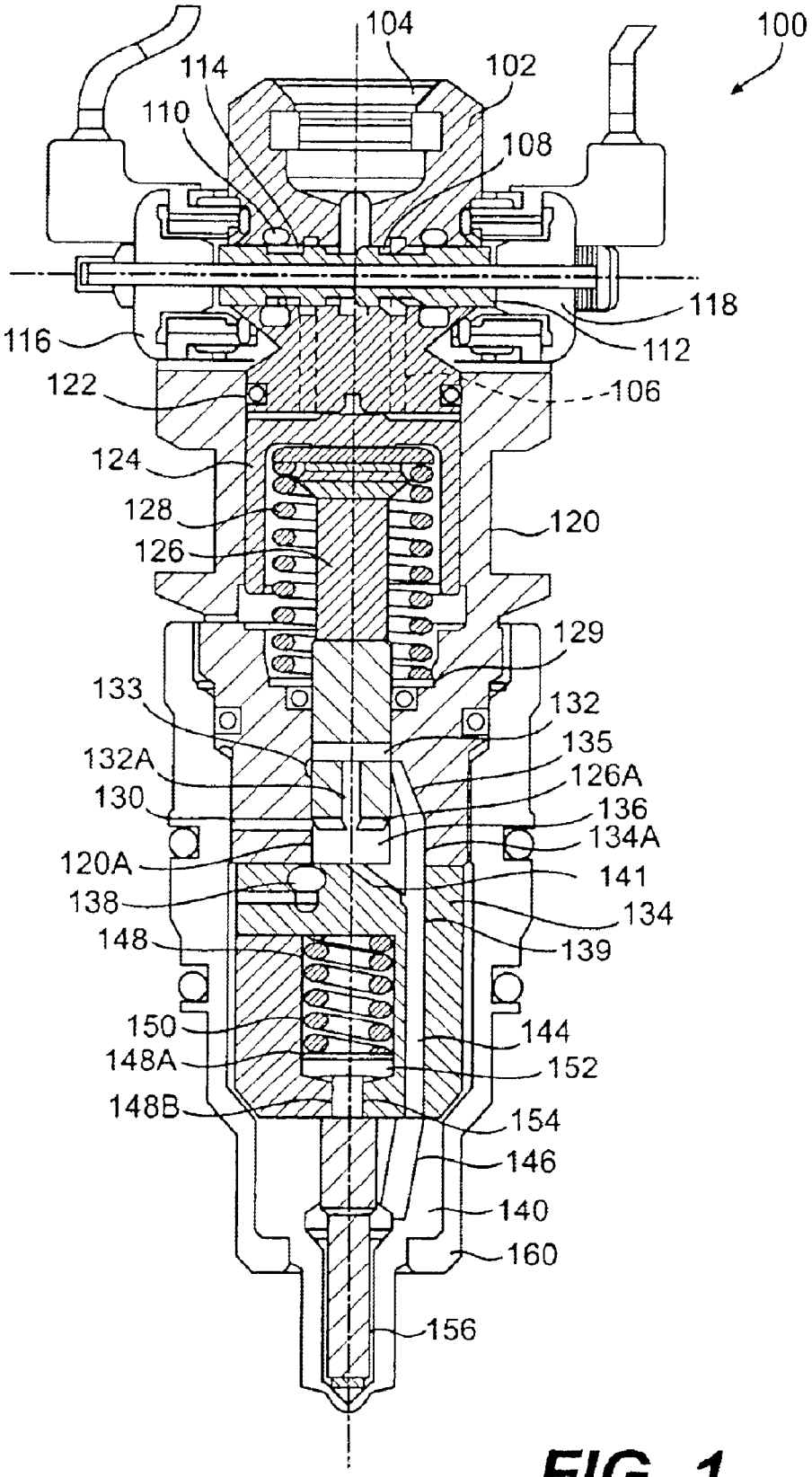
FIG. 1 shows an oil activated fuel injector of the present invention.

Referring now to FIG. 1, an overview of the fuel injector of the present invention is shown. The fuel injector is generally depicted as reference numeral 100 and includes a control valve body 102 as well as an intensifier body 120 and a nozzle 140. The control valve body 102 includes an inlet area 104 which is in fluid communication with working ports 106. At least one groove or orifice (hereinafter referred to as grooves) 108 are positioned between and in fluid communication with the inlet area 104 and the working ports 106. At least one of vent hole 110 (and preferably two ore more) is located in the control body 102 which are in fluid communication with the working ports 106.

A spool 112 having at least one groove or orifice (hereinafter referred to as grooves) 114 is slidably mounted within the control valve body 102. An open coil 116 and a closed coil 118 are positioned on opposing sides of the spool 112 and are energized via a driver (not shown) to drive the spool 112 between a closed position and an open position. In the open position, the grooves 114 of the spool 112 are aligned with the grooves 108 of the valve control body 102 thus allowing the working fluid to flow between the inlet area 104 and the working ports 106 of the valve control body 102.

Still referring to FIG. 1, the intensifier body 120 is mounted to the valve control body 102 via any conventional mounting mechanism. A seal 122 (e.g., o-ring) may be positioned between the mounting surfaces of the intensifier body 120 and the valve control body 102. A piston 124 is slidably positioned within the intensifier body 120 and is in contact with an upper end of a plunger 126. An intensifier spring 128 surrounds a portion (e.g., shaft) of the plunger 126 and is further positioned between the piston 124 and a flange or shoulder 129 formed on an interior portion of the intensifier body 120. The intensifier spring 128 urges the piston 122 and the plunger 126 in a first position proximate to the valve control body 102. A pressure release hole 130 is formed in the body of the intensifier body 120. The pressure release hole 130 may be further positioned adjacent the plunger 126.

As further seen in FIG. 1, a cross bore 132 is formed at an end portion 126*a* of the plunger 126. The bore 132 may be a radial bore. A longitudinal bore 132*a,* positioned substantially perpendicular to the cross bore 132, is formed at an end of the plunger 126 and provides fluid communication between the cross bore 132 and a high pressure chamber 136. This, in turn, allows fuel to flow between the high pressure chamber 136 and the fuel bore to the nozzle of the injector. A groove 133 is formed in the intensifier body 120 proximate to the cross bore 132 such that the cross bore 132 overlaps with the groove 133 after a pre-stroke injection cycle (and during a remaining injection cycle) of the plunger 126. In embodiments, the pre-stroke of the plunger is 10% to 30% of the entire plunger stroke.

A check disk 134 is positioned below the intensifier body 120 remote from the valve control body 102. The combination of an upper surface 134*a* of the check disk 134, an end portion 126*a* of the plunger 126 and an interior wall 120*a* of the intensifier body 120 forms the high pressure chamber 136. A fuel inlet check valve 138 is positioned within the check disk 134 and provides fluid communication between the high pressure chamber 136 and a fuel area (not shown). This fluid communication allows fuel to flow into the high pressure chamber 136 from the fuel area during an up-stroke of the plunger 126. The pressure release hole 130 is also in fluid communication with the high pressure chamber 136 when the plunger 126 is urged into the first position; however, fluid communication is interrupted when the plunger 126 is urged downwards towards the check disk 134. The check disk 134 also includes a fuel bore 139 in fluid communication with a fuel bore 135 in the intensifier body 120. The fuel bore 135 is in fluid communication with the groove 133, and also may be positioned at an angle with respect to the fuel bore 139.

A throttle 141 is in fluid communication with the fuel bore 135, the fuel bore 139 or the groove 133, and may be located in the check disk 134, the plunger 126 or the intensifier body 120 (depending on the particular embodiment). The cross section of the throttle, in embodiments, has a smaller cross section than the fuel bore and the longitudinal bore of the plunger. This allows a small quantity of fuel to be supplied to the fuel bore prior to the main injection event.

FIG. 1 further shows the nozzle 140 and a spring cage 142. The spring cage 142 is positioned between the nozzle 140 and the check disk 134, and includes a straight fuel bore 144 in fluid communication with the fuel bore 139 of the check disk 134. The spring cage 142 also includes a centrally located bore 148 having a first bore diameter 148*a* and a second smaller bore diameter 148*b*. A spring 150 and a spring seat 152 are positioned within the first bore diameter 148*a* of the spring cage 142, and a pin 154 is positioned within the second smaller bore diameter 148*b*.

The nozzle 140 includes an angled bore 146 in alignment with the bore 139 of the spring cage 142. A needle 150 is preferably centrally located with the nozzle 140 and is urged downwards by the spring 150 (via the pin 154). A fuel chamber 152 surrounds the needle 150 and is in fluid communication with the angled bore 146. In embodiments, a nut 160 is threaded about the intensifier body 120, the check disk 134, the nozzle 140 and the spring cage 142.

Figure 2:
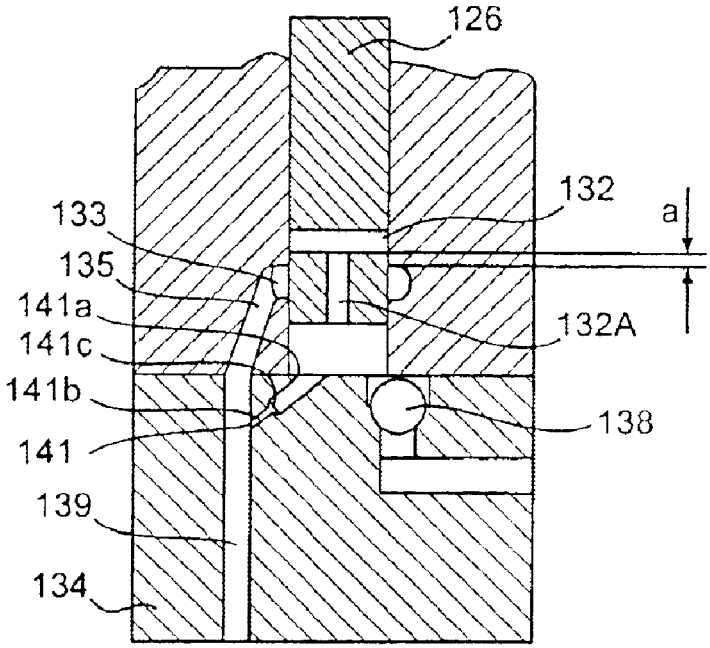
FIG. 2 shows an embodiment of the present invention.

FIG. 2 shows an embodiment of the present invention. In this embodiment, the throttle 141 is positioned within the check disk 134, and provides fluid communication between the high pressure chamber 136 and the fuel bore 139. The throttle 141 includes a first diameter bore 141*a* and a second diameter bore 141*b* with a conically sloped transition wall 141*c* positioned therebetween. The throttle 141 may also be machined to have one cross sectional area. The first diameter bore 141*a* is preferably larger in diameter than the second diameter bore 141*b,* and is in fluid communication with the high pressure chamber 136. The second diameter bore 141*b* of the throttle 141, on the other hand, is in fluid communication with the fuel bore 139. The smaller diameter bore 141*b* allows for a small fuel injection quantity to flow into the fuel bore 139 during the pre-stroke stage of the plunger (as further discussed below). The distance "a" represents the pre-stroke distance of the plunger; that is, during the distance "a", fuel flows through the throttle 141 and into the fuel bore without a main injection event.

Figure 3:
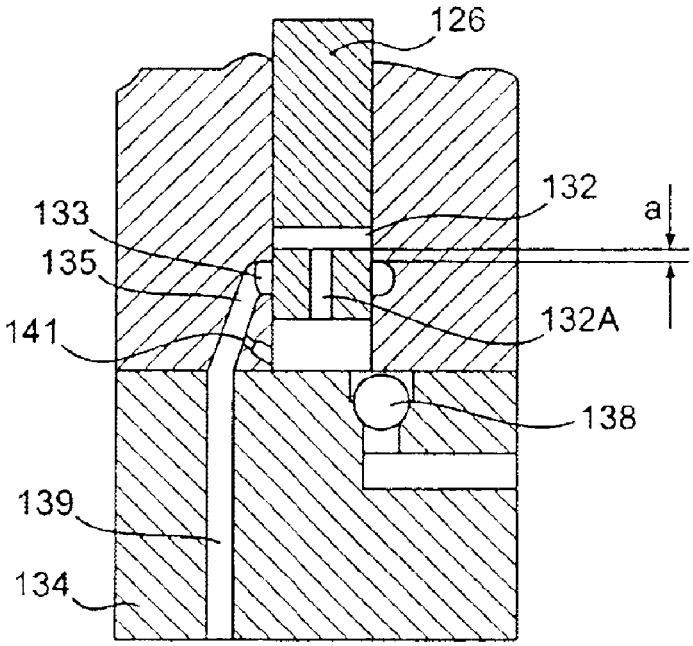
FIG. 3 shows an embodiment of the present invention.

FIG. 3 is another embodiment of the present invention. In this embodiment, the throttle 141 is positioned within the intensifier body 120. In this position, the throttle 141 provides fluid communication between the high pressure chamber 139 and the fuel bore 135 of the intensifier chamber 120. As in FIG. 2, the first diameter bore 141*a* is in fluid communication with the high pressure chamber 136 and the second diameter bore 141*b* of the throttle 141 is in fluid communication with the fuel bore 139 in order to allow a smaller quantity of fuel to flow into the fuel bore 135 during the pre-stroke of the plunger 126.

Figure 4:
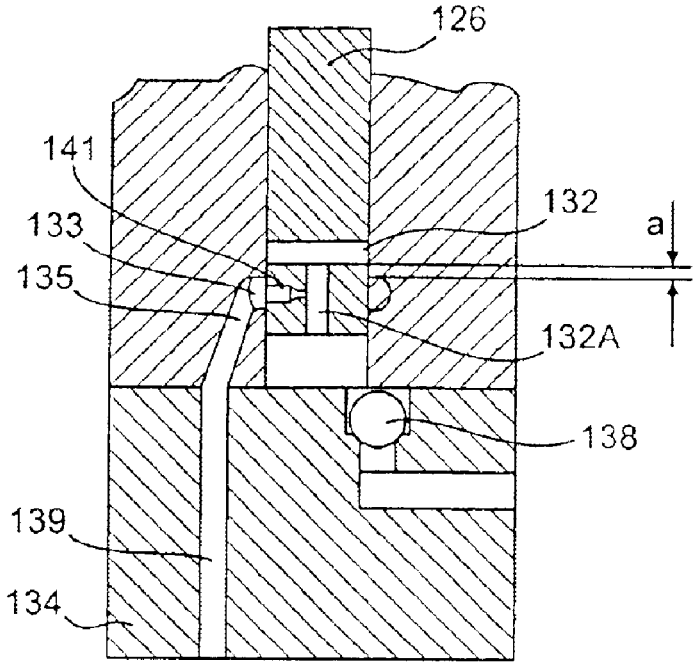
FIG. 4 shows an embodiment of the present invention.

FIG. 4 is still another embodiment of the present invention. In this embodiment, the throttle 141 is positioned within the plunger 126 and provides fluid communication between the longitudinal bore 132*a* and the fuel bore 135 during the pre-stroke phase of the plunger. In the embodiment of FIG. 4, the first diameter bore 141*a* is in fluid communication with the high pressure chamber 136 and the second diameter bore 141*b* of the throttle 141 is in fluid communication with the fuel bore 139 in order to allow a smaller quantity of fuel to flow into the fuel bore during the pre-stroke of the plunger.

Figure 5:
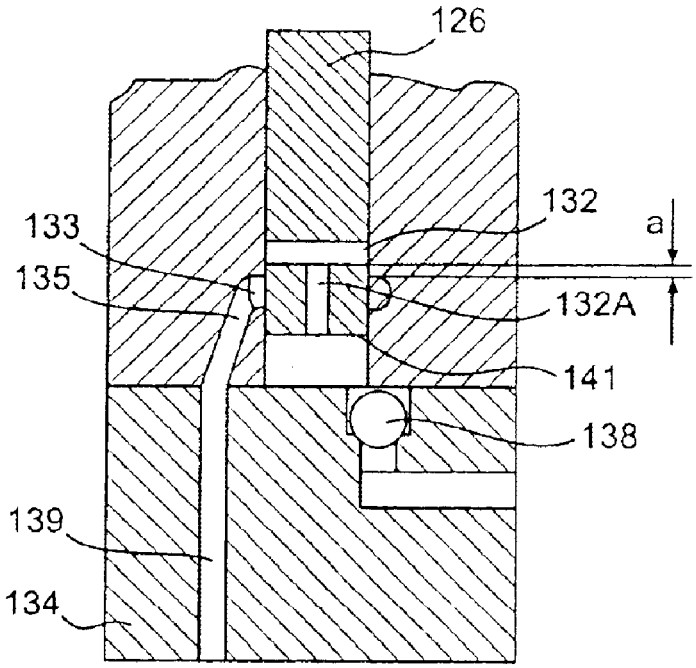
FIG. 5 shows an embodiment of the present invention.

FIG. 5 shows another embodiment of the present invention. In the embodiment of FIG. 5, the throttle 141 is a clearance at the side of the plunger. Again, the throttle 141 is in fluid communication with the fuel bore 139 in order to allow a smaller quantity of fuel to flow into the fuel bore during the pre-stroke of the plunger.

Figure 6:
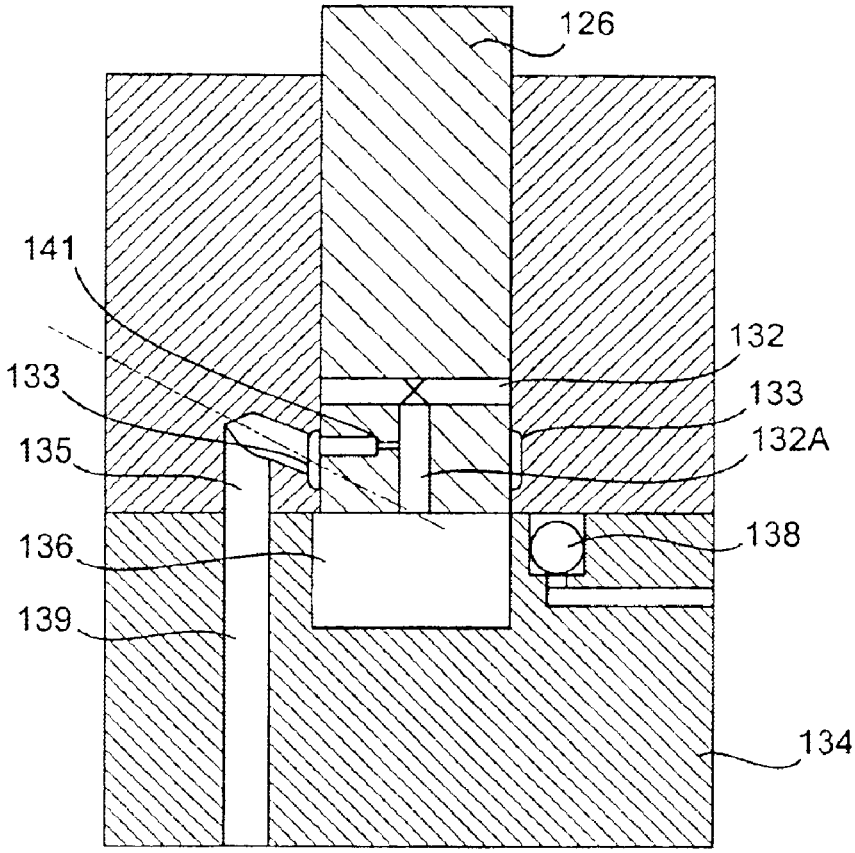
FIG. 6 shows an embodiment of the present invention.

FIG. 6 shows the fuel bore 135 at a same angle (straight) as the fuel bore 139. In the embodiment of FIG. 6, a portion of the fuel bore 135, proximate to the groove 133, may be drilled or milled from the inside. This allows the wall thickness of the intensifier body to be increased between the high pressure chamber 136 and the fuel bore 135 so as to realize a higher pressure resistance.

Figure 7:
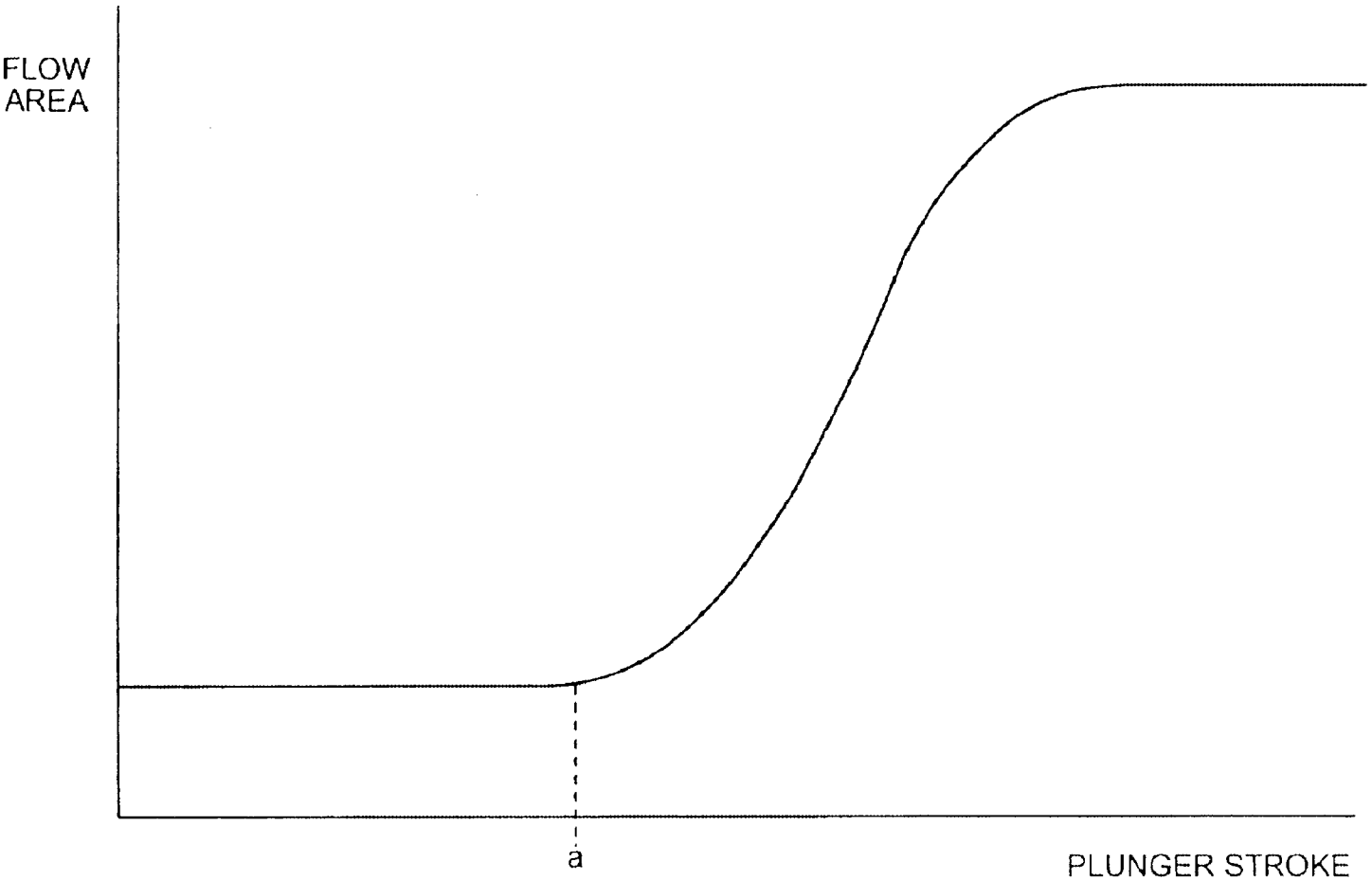
FIG. 7 shows a performance graph utilizing the oil activated fuel injector of the present invention.

FIG. 7 shows a graph depicting flow area between the plunger and the nozzle versus plunger stroke. As can be seen from FIG. 7, the flow area is smaller during the pre-stroke stage of the plunger; whereas, the fuel area is larger during the main injection. This shows that the pre-stroke injection provides a pilot injection (approximately 5%) to the engine prior to the main injection event. In this manner, emissions and engine noise may be lowered by the present invention.

Operation of the Oil Activated Fuel Injector of the Present Invention

In operation, a driver (not shown) will first energize the open coil 116. The energized open coil 116 will then shift the spool 112 from a start position to an open position. In the open position, the grooves 108 of the control valve body 102 will become aligned with the grooves 114 on the spool 112. The alignment of the grooves 108 and 114 will allow the pressurized working fluid to flow from the inlet area 104 to the working ports 106 of the control valve body 102.

Once the pressurized working fluid is allowed to flow into the working ports 106 it begins to act on the piston 124 and the plunger 126. That is, the pressurized working fluid will begin to push the piston 124 and the plunger 126 downwards thus compressing the intensifier spring 128. As the piston 124 is pushed downward, fuel in the high pressure chamber will begin to be compressed via the end portion 126*a* of the plunger. A small quantity of compressed fuel will be forced through the throttle 141 into the fuel bores and into the chamber 158 which surrounds the needle 156. During this pre-stroke cycle, a pilot quantity of fuel can then be injected into the engine thus reducing emissions and engine noise. The pre-stroke distance "a" is preferably 10% to 30% of the plunger stroke.

As the pressure increases, the plunger 126 will be pushed further downward until the cross bore 132 is in fluid communication with the groove 133 and hence the fuel bores. At this stage, fuel in the high pressure chamber will be forced through the longitudinal bore 132*a,* into the cross bore 132 and into the fuel bores. The fuel will then flow into the chamber 158 which surrounds the needle 156. As the pressure working ports 106 increases, the fuel pressure will rise above a needle check valve opening pressure until the needle spring 148 is urged upwards. At this stage, the injection holes are open in the nozzle 140 thus allowing a main fuel quantity to be injected into the combustion chamber of the engine.

To end the injection cycle, the driver will energize the closed coil 118. The magnetic force generated in the closed coil 118 will then shift the spool 112 into the closed or start position which, in turn, will close the working ports 106 of the control valve body 102. That is, the grooves 108 and 114 will no longer be in alignment thus interrupting the flow of working fluid from the inlet area 104 to the working ports 106. At this stage, the needle spring 150 will urge the needle 156 downward towards the injection holes of the nozzle 140 thereby closing the injection holes. Similarly, the intensifier spring 128 urges the plunger 126 and the piston 124 into the closed or first position adjacent to the valve control body 102. As the plunger 126 moves upward, the pressure release hole 132 will release pressure in the high pressure chamber 136 thus allowing fuel to flow into the high pressure chamber 136 (via the fuel inlet check valve 138). Now, in the next cycle the fuel can be compressed in the high pressure chamber 136. As the plunger 126 and the piston 124 move towards the valve control body 102, the working fluid will begin to be vented through the vent holes 110.

While the invention has been described in terms of preferred embodiments, those skilled in the art will recognize that the invention can be practiced with modification within the spirit and scope of the appended claims.

Having thus described our invention, what we claim as new and desire to secure by Letters Patent is as follows:

1. A fuel injector, comprising:

a spool slidable between a first position and a second position;

an open and closed solenoid positioned on respective sides of the spool;

an intensifier body positioned proximate to the spool;

a piston slidably positioned within the intensifier body;

a plunger being in contact with the piston, the plunger having a cross bore and a longitudinal bore in fluid communication with the cross bore;

a high pressure chamber formed below the plunger;

means for supplying fuel to a nozzle in fluid communication with the high pressure chamber, the means for supplying fuel extending within at least the intensifier body;

a throttle for supplying a pilot quantity of fuel between the high pressure chamber and the means for supplying fuel to the fuel nozzle; and a check disk positioned below the plunger, the throttle being located within the check disk.

2. The fuel injector of claim 1, wherein the throttle provides fluid communication between the high pressure chamber and the means for supplying fuel to the fuel nozzle extending within the check disk.

3. A fuel injector, comprising:

a spool slidable between a first position and a second position;

an open and closed solenoid positioned on respective sides of the spool:

an intensifier body positioned proximate to the spool;

a piston slidably positioned within the intensifier body;

a plunger being in contact with the piston, the plunger having a cross bore and a longitudinal bore in fluid communication with the cross bore;

a high pressure chamber formed below the plunger;

means for supplying fuel to a nozzle in fluid communication with the high pressure chamber, the means for supplying fuel extending within at least the intensifier body;

a means for supplying a pilot quantity of fuel between the high pressure chamber and the means for supplying fuel to the fuel nozzle;

wherein the means for supplying fuel to the fuel nozzle are fuel bores extending through at least the check disk and the intensifier body, the fuel bore of the check disk and the fuel bore of the intensifier body being in axial alignment.

* * * * *